US006971739B2

(12) United States Patent
Sadasivan et al.

(10) Patent No.: US 6,971,739 B2
(45) **Date of Patent: *Dec. 6, 2005**

(54) METHOD AND APPARATUS FOR PRINTING

(75) Inventors: Sridhar Sadasivan, Rochester, NY (US); Seshadri Jagannathan, Pittsford, NY (US); Suresh Sunderrajan, Rochester, NY (US); Gary E. Merz, Rochester, NY (US); John E. Rueping, Spencerport, NY (US); Glen C. Irvin, Jr., Rochester, NY (US); Ramesh Jagannathan, Rochester, NY (US); Rajesh V. Mehta, Rochester, NY (US); David J. Nelson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 339 days.

This patent is subject to a terminal disclaimer.

(21) Appl. No.: 10/162,956

(22) Filed: Jun. 5, 2002

(65) Prior Publication Data

US 2003/0227502 A1 Dec. 11, 2003

(51) Int. Cl.[7] ..... B41J 2/175; B41J 2/015; B41J 2/17

(52) U.S. Cl. ..... 347/85; 347/21; 347/95

(58) Field of Search ..... 347/5, 10–12, 347/14, 19–21, 44–47, 54, 56, 65, 67, 85, 347/86, 95; 239/422; 356/380; 400/74, 708, 400/709

(56) References Cited

U.S. PATENT DOCUMENTS 4,027,308 A * 5/1977 Fan et al. ..... 347/75
4,734,227 A 3/1988 Smith
5,573,682 A 11/1996 Beason, Jr.
5,646,656 A 7/1997 Leonhardt
6,116,718 A 9/2000 Peeters et al.
6,672,702 B2 * 1/2004 Sadasivan et al. ..... 347/19

FOREIGN PATENT DOCUMENTS

EP 0317219 5/1989
EP 0473424 4/1992
EP 1236519 4/2002

OTHER PUBLICATIONS

U.S. Patent Application Kodak Docket No. 83578, commonly assigned, entitled Method and Apparatus for Printing, Cleaning and Calibrating, filed concurrently herewith.

* cited by examiner

*Primary Examiner*—Stephen Meier
*Assistant Examiner*—An H. Do
(74) *Attorney, Agent, or Firm*—William R. Zimmerli

(57) ABSTRACT

A method and apparatus for delivering solvent free marking material to a receiver is provided. A printhead includes a discharge device having an inlet and an outlet with a portion of the discharge device defining a delivery path. An actuating mechanism is moveably positioned along the delivery path. A material selection device has an inlet and an outlet with the outlet of the material selection device being connected in fluid communication to the inlet of the discharge device. The inlet of the material selection device is adapted to be connected to a pressurized source of a thermodynamically stable mixture of a fluid and a marking material, wherein the fluid is in a gaseous state at a location beyond the outlet of the discharge device.

17 Claims, 10 Drawing Sheets

METHOD AND APPARATUS FOR PRINTING

CROSS REFERENCE TO RELATED APPLICATIONS

Reference is made to commonly assigned U.S. patent application Ser. No. 10/163,326, filed concurrently herewith, now U.S. Pat. No. 6,672,702, entitled Method And Apparatus For Printing, Cleaning, and Calibrating.

FIELD OF THE INVENTION

This invention relates generally to printing and more particularly, to printing using solvent free materials.

BACKGROUND OF THE INVENTION

Traditionally, digitally controlled printing capability is accomplished by one of two technologies. The first technology, commonly referred to as "continuous stream" or "continuous" ink jet printing, uses a pressurized ink source which produces a continuous stream of ink droplets (typically containing a dye or a mixture of dyes). Conventional continuous inkjet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or disposed of. When print is desired, the ink droplets are not deflected and allowed to strike a print media. Alternatively, deflected ink droplets may be allowed to strike the print media, while non-deflected ink droplets are collected in the ink capturing mechanism.

The second technology, commonly referred to as "drop-on-demand" ink jet printing, provides ink droplets (typically including a dye or a mixture of dyes) for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

Conventional "drop-on-demand" ink jet printers utilize a pressurization actuator to produce the ink jet droplet at orifices of a print head. Typically, one of two types of actuators are used including heat actuators and piezoelectric actuators. With heat actuators, a heater, placed at a convenient location, heats the ink causing a quantity of ink to phase change into a gaseous steam bubble that raises the internal ink pressure sufficiently for an ink droplet to be expelled. With piezoelectric actuators, an electric field is applied to a piezoelectric material possessing properties that create a mechanical stress in the material causing an ink droplet to be expelled. The most commonly produced piezoelectric materials are ceramics, such as lead zirconate titanate, barium titanate, lead titanate, and lead metaniobate.

Conventional ink jet printers are disadvantaged in several ways. For example, in order to achieve very high quality images having resolutions approaching 900 dots per inch while maintaining acceptable printing speeds, a large number of discharge devices located on a printhead need to be frequently actuated thereby producing an ink droplet. While the frequency of actuation reduces printhead reliability, it also limits the viscosity range of the ink used in these printers. Typically, the viscosity of the ink is lowered by adding solvents such as water, etc. The increased liquid content results in slower ink dry times after the ink has been deposited on the receiver which decreases overall productivity. Additionally, increased solvent content can also cause an increase in ink bleeding during drying which reduces image sharpness negatively affecting image resolution and other image quality metrics.

Conventional ink jet printers are also disadvantaged in that the discharge devices of the printheads can become partially blocked and/or completely blocked with ink. In order to reduce this problem, solvents, such as glycol, glycerol, etc., are added to the ink formulation, which can adversely affect image quality. Alternatively, discharge devices are cleaned at regular intervals in order to reduce this problem. This increases the complexity of the printer.

Another disadvantage of conventional inkjet printers is their inability to obtain true gray scale printing. Conventional ink jet printers produce gray scale by varying drop density while maintaining a constant drop size. However, the ability to vary drop size is desired in order to obtain true gray scale printing.

Other technologies that deposit a dye onto a receiver using gaseous propellants are known. For example, Peeters et al., in U.S. Pat. No. 6,116,718, issued Sep. 12, 2000, discloses a print head for use in a marking apparatus in which a propellant gas is passed through a channel, the marking material is introduced controllably into the propellant stream to form a ballistic aerosol for propelling non-colloidal, solid or semi-solid particulate or a liquid, toward a receiver with sufficient kinetic energy to fuse the marking material to the receiver. There is a problem with this technology in that the marking material and propellant stream are two different entities and the propellant is used to impart kinetic energy to the marking material. When the marking material is added into the propellant stream in the channel, a non-colloidal ballistic aerosol is formed prior to exiting the print head. This non-colloidal ballistic aerosol, which is a combination of the marking material and the propellant, is not thermodynamically stable/metastable. As such, the marking material is prone to settling in the propellant stream which, in turn, can cause marking material agglomeration, leading to discharge device obstruction and poor control over marking material deposition.

Technologies that use supercritical fluid solvents to create thin films are also known. For example, R. D. Smith in U.S. Pat. No. 4,734,227, issued Mar. 29, 1988, discloses a method of depositing solid films or creating fine powders through the dissolution of a solid material into a supercritical fluid solution and then rapidly expanding the solution to create particles of the marking material in the form of fine powders or long thin fibers, which may be used to make films. There is a problem with this method in that the free-jet expansion of the supercritical fluid solution results in a non-collimated/defocused spray that cannot be used to create high-resolution patterns on a receiver. Further, defocusing leads to losses of the marking material.

As such, there is a need for a technology that permits high speed, accurate, and precise delivery of marking materials to a receiver to create high resolution images. There is also a need for a technology that permits delivery of ultra-small (nano-scale) marking material particles of varying sizes to obtain gray scale. There is also a need for a technology that permits delivery of solvent free marking materials to a receiver.

SUMMARY OF THE INVENTION

According to one feature of the present invention, a printhead for delivering marking material to a receiver includes a discharge device having an inlet and an outlet with a portion of the discharge device defining a delivery path. An actuating mechanism is moveably positioned along the delivery path. A material selection device has an inlet and an outlet with the outlet of the material selection device being connected in fluid communication to the inlet of the discharge device. The inlet of the material selection device is adapted to be connected to a pressurized source of a thermodynamically stable mixture of a fluid and a marking material, wherein the fluid is in a gaseous state at a location beyond the outlet of the discharge device.

According to another feature of the present invention, a printing apparatus includes a pressurized source of a thermodynamically stable mixture of a compressed fluid and a marking material and a pressurized source of a compressed fluid. A material selection device has a plurality of inlets and an outlet with one of the plurality of inlets being connected in fluid communication to the pressurized source of compressed fluid and another of the plurality of inlets being connected in fluid communication to the thermodynamically stable mixture of the compressed fluid and the marking material. A printhead, portions of which define a delivery path has an inlet and an outlet with the inlet of the delivery path being connected in fluid communication to the outlet of the material selection device. An actuating mechanism is moveably positioned along the delivery path and the compressed fluid is in a gaseous state at a location beyond the outlet of the delivery path.

According to another feature of the present invention, a method of printing includes providing a printhead with portions of the printhead defining a delivery path having an inlet and an outlet with the printhead being connected in fluid communication to a source of compressed fluid and a first marking material, a source of compressed fluid and a second marking material, and a source of compressed fluid at the inlet; delivering the first marking material to a receiver; cleaning the delivery path; and delivering the second marking material to the receiver.

According to another feature of the present invention, a method of printing includes providing a printhead with portions of the printhead defining a delivery path having an inlet and an outlet with the printhead being connected in fluid communication to a source of compressed fluid and a marking material, and a source of compressed fluid at the inlet; delivering a first predetermined amount of the marking material to a receiver; calibrating to a second predetermined amount of the marking material; and delivering the second predetermined amount of the marking material to the receiver.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1A:
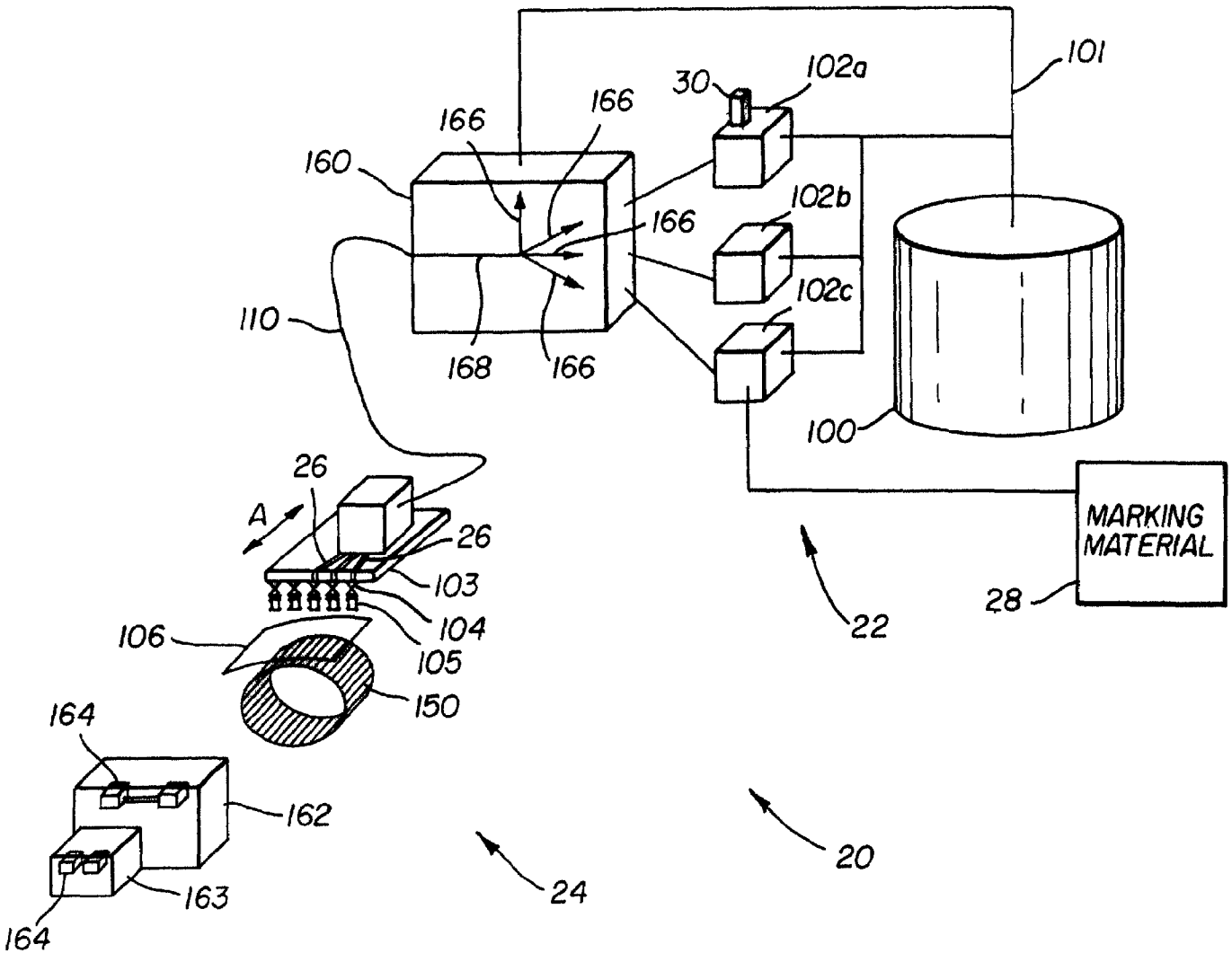
FIGS. 1A–1C are schematic views of a first embodiment made in accordance with the present invention.

The present description will be directed in particular to elements forming part of, or cooperating more directly with, apparatus in accordance with the present invention. It is to be understood that elements not specifically shown or described may take various forms well known to those skilled in the art. Additionally, materials identified as suitable for various facets of the invention, for example, marking materials, solvents, equipment, etc. are to be treated as exemplary, and are not intended to limit the scope of the invention in any manner.

Referring to FIGS. 1A–1C, and 4–7B, a printing apparatus 20 is shown. The printing apparatus 20 includes a marking material delivery system 22 and a receiver retaining device 24. The marking material delivery system has a pressurized source of a thermodynamically stable mixture of a fluid and a marking material, herein after referred to as a formulation reservoir(s) 102*a*, 102*b*, 102*c*, connected in fluid communication to a delivery path 26 at least partially formed in/on a printhead 103. The printhead 103 includes a discharge device 105 positioned along the delivery path 26 configured (as discussed below) to produce a shaped beam of the marking material. An actuating mechanism 104 is also positioned along the delivery path 26 and is operable to control delivery of the marking material though the printhead 103.

The formulation reservoir(s) 102*a*, 102*b*, 102*c* is connected in fluid communication to a source of fluid 100 and a source of marking material 28 (shown with reference to formulation reservoir 102*c* in FIG. 1A). Alternatively, the marking material can be added to the formulation reservoir(s) 102*a*, 102*b*, 102*c* through a port 30 (shown with reference to formulation reservoir 102*a* in FIG. 1A).

One formulation reservoir 102*a*, 102*b*, or 102*c* can be used when single color printing is desired. Alternatively, multiple formulation reservoirs 102*a*, 102*b*, or 102*c* can be used when multiple color printing is desired. When multiple formulation reservoirs 102*a*, 102*b*, 102*c* are used, each formulation reservoir 102*a*, 102*b*, 102*c* is connected in fluid communication through delivery path 26 to a discharge device(s) 105. A material selection device 160 is appropriately positioned along delivery path 26 such that each discharge device(s) 105 can selectively eject marking material from each formulation reservoir 102*a*, 102*b*, 102*c* depending on the position of material selection device 160. Additionally, at least one inlet of the material selection device 160 is connected to the source of fluid 100.

A discussion of illustrative embodiments follows with like components being described using like reference symbols.

Figure 1B:
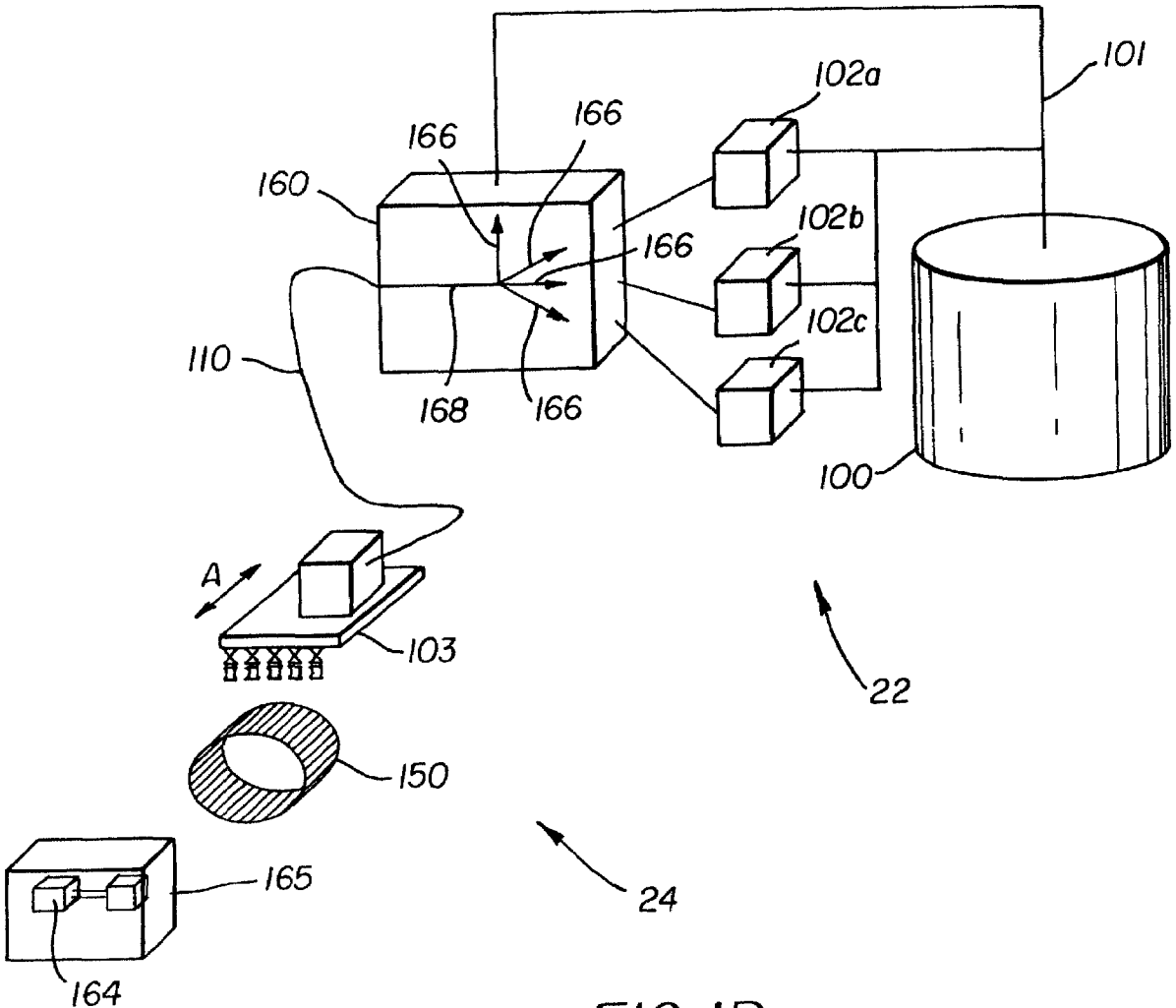
Figure 1C:
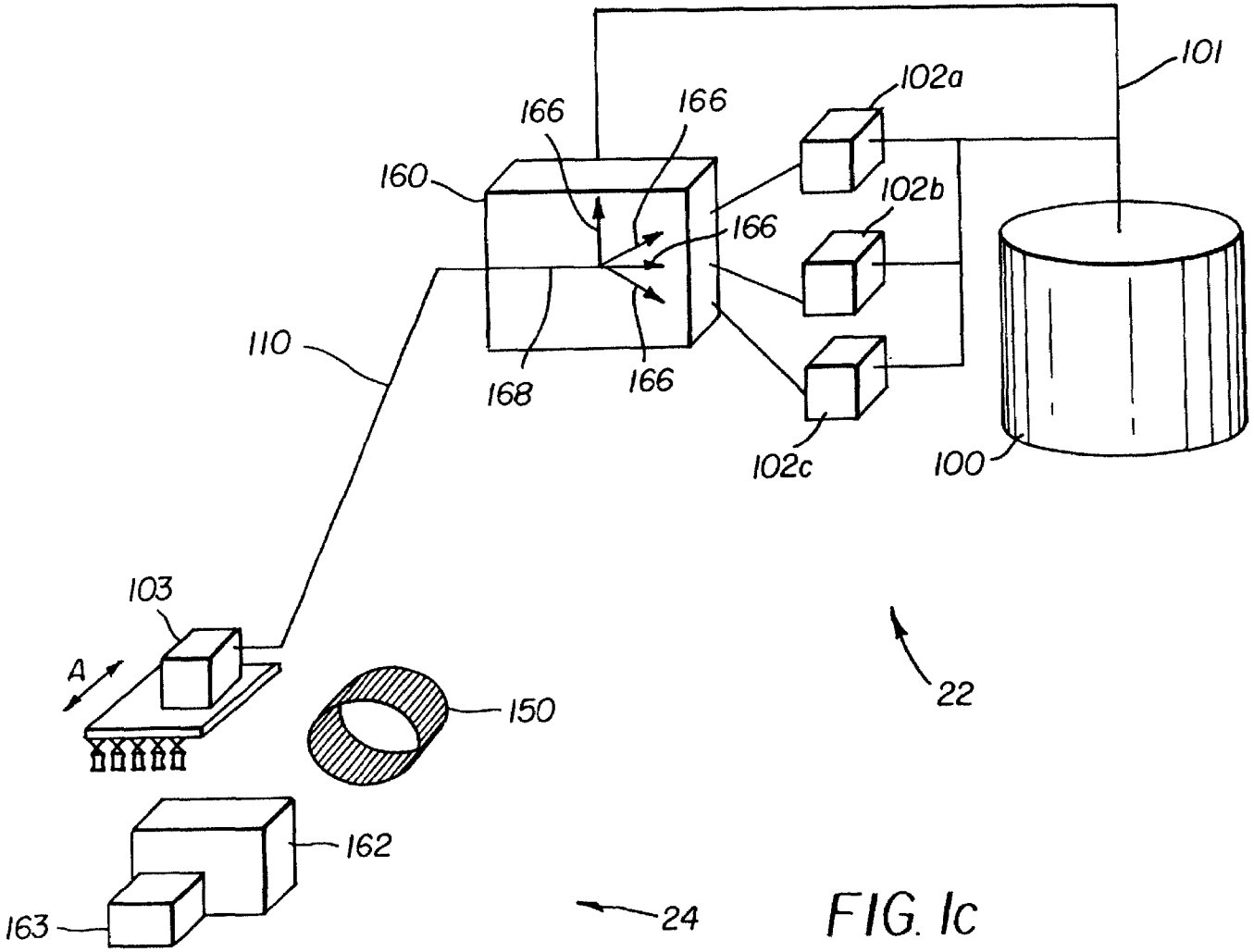
Figure 2A:
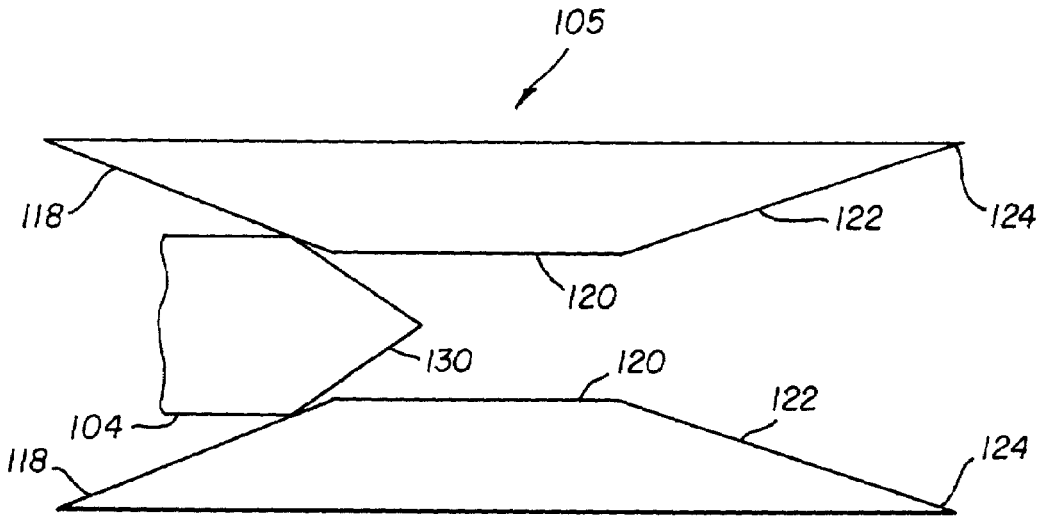
FIGS. 2A–3B are schematic views of a discharge device and actuating mechanism made in accordance with the present invention.
Figure 2B:
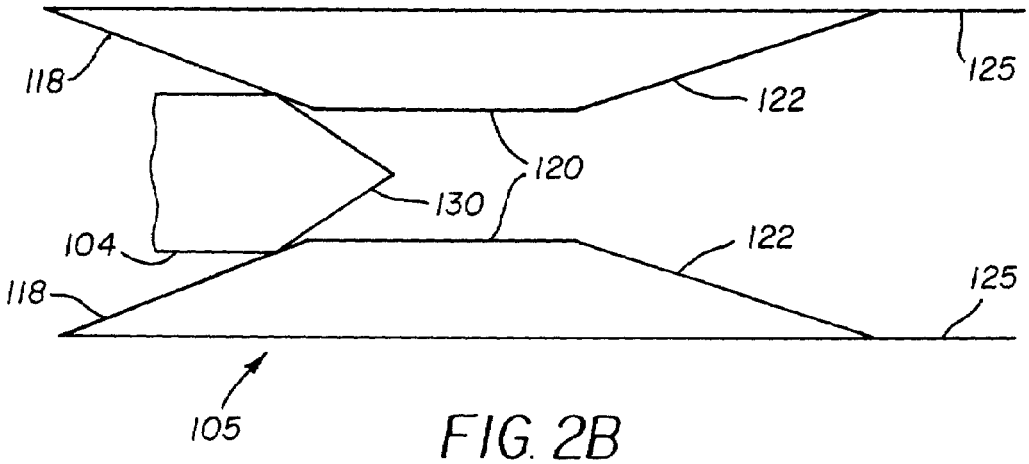
Figure 3A:
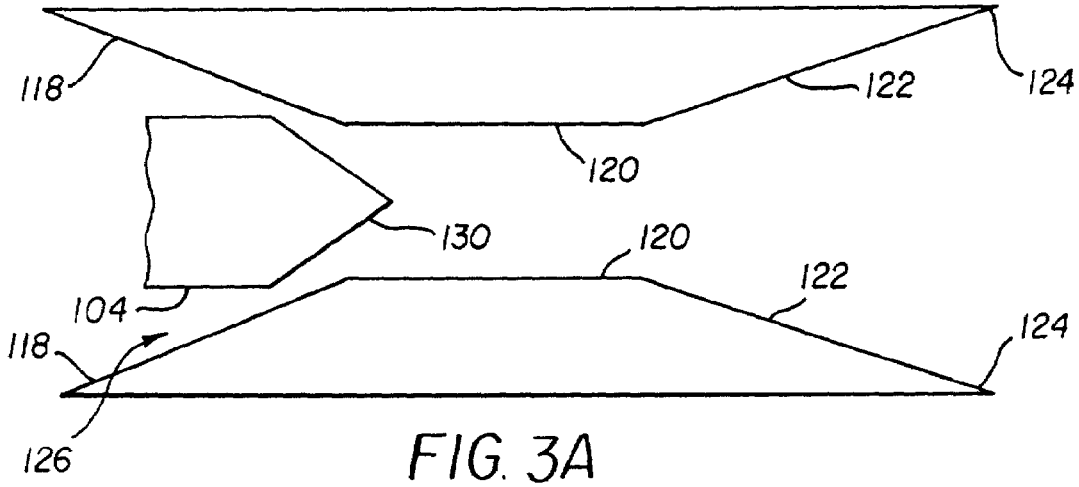
Figure 3B:
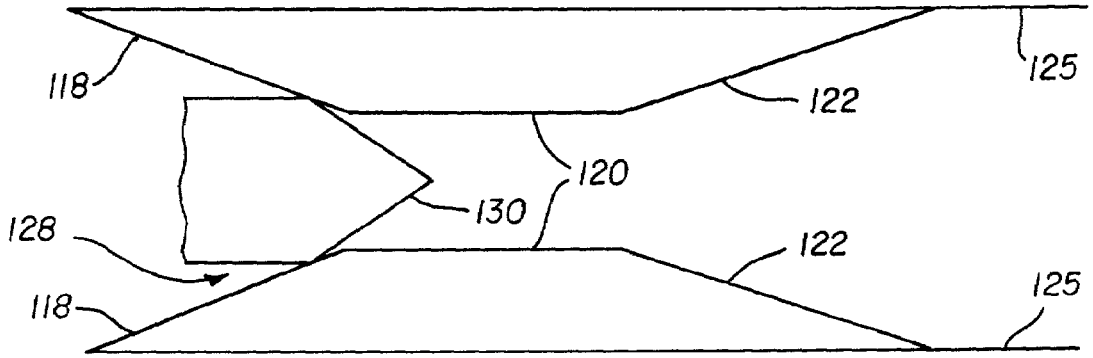

Referring to FIGS. 1A–1C, printhead 103, which includes at least one discharge device 105 and actuating mechanism 104 as described below with reference to FIGS. 5A–5C, is moveable (arrow A) between a first position where printing occurs (as shown in FIGS. 1A and 1B) and a second position where cleaning and/or calibration occurs (as shown in FIG. 1C). Printhead 103 translates in a first direction while receiver retaining device 24 translates in at least one other direction. A rotatable drum 150 that rotates in a second direction relative to printhead 103 during printing is shown in FIGS 1A–1C. Alternatively, other types of receiver retaining devices 24 can be used with the printing system of the present invention, for example, x, y, z translation stages, rollers, individual receiver trays, etc.

Printhead 103 is connected to material selection device 160 through flexible tubing 110 which allows printhead 103 to translate between the first position over receiver retaining device 24 and the second position over a cleaning station 162 and/or a calibrating station 163. Any suitable flexible tubing 110 can be used, for example, a Titeflex extra high-pressure hose P/N R157-3 (0.110 inside diameter, 4000 psi rated with a 2 in bend radius) commercially available from Kord Industrial, Wixom, Mich. In this embodiment, rigid tubing 101 connects material selection device 160 to formulation reservoir 102*a*, 102*b*, 102*c* and fluid source 100.

Alternatively, flexible tubing 110 can be replaced with rigid tubing 101 with appropriate modifications to the receiver retaining device 24 and the cleaning station 162 and calibrating station 163. When rigid tubing 101 replaces flexible tubing 110, the receiver retaining device 24 should be able to translate in at least two directions during printing. This can be accomplished using, for example, x, y translation stages in any known manner. Alternatively, printhead 103 can be a page width type printhead with receiver retaining device 24 being moveable in at least one direction. Additionally, the cleaning station 162 and/or the calibrating station 163 can be modified such that cleaning station 162 and/or calibrating station 163 can be positioned in the material delivery path of printhead 103. This can be accomplished using, for example, a solenoid mechanism that extends and retracts cleaning station 162 and/or calibrating station 163 into and from the material delivery path.

During a multicolor printing operation, each color is printed sequentially, rather than in parallel. As such, each discharge device 105 of printhead 103 is used to eject each printed color which helps to maximize the resolution of printhead 103. For example, material selection device 160 is positioned to allow a marking material (for example, a first color) from formulation reservoir 102*a* to be ejected through discharge devices 105 on printhead 103. Printhead 103 and receiver retaining device 24 move together in one of the ways described above to print the marking material from formulation reservoir 102*a* on receiver 106. Actuating mechanism 104 is actuated in order to deliver the correct amount of material at the appropriate time and receiver location. When this process is complete, printhead 103 translates to cleaning station 162, as shown in FIG. 1C. Any marking material from formulation reservoir 102*a* remaining in line 110 is purged at the cleaning station 162 by positioning the material selection device 160 to allow fluid from source 100 to be ejected from discharge devices 105 and actuating mechanism 104. The above described process is then repeated in order to eject material from formulation reservoirs 102*b* and 102*c*.

Typically, the purging operation is performed for a predetermined amount of time and can be calculated using characteristics of the printing system 20 such as material mass flow rates, length of line 110, etc. Alternatively, a material sensing system 164 positioned in cleaning station 162 can be used to verify that the marking material from one formulation reservoir 102*a*, 102*b*, 102*c* has been removed from the line 110 prior to ejecting material from another of formulation reservoirs 102*a*, 102*b*, 102*c*.

When material sensing system 164 is used to determine whether material from one formulation reservoir 102*a*, 102*b*, 102*c* has been purged from line 110, a closed loop sensing operation is generally preferred. In this operation, purging continues until sensing system 164 indicates that an acceptable level of marking material remains in line 110. Sensing systems 164 of this type typically analyze ejected streams of marking material having individual particle sizes ranging from approximately 10 microns to approximately 100 microns and usually include a CCD sensor or camera with appropriate optics and a light source positioned away from the sensor or camera on the opposite side of the marking material stream. Suitable equipment for this type of marking material stream analysis is, for example, a Sony model #XC-75 camera, a Navitar Zoom lens P/N 60135, and a fiber-optic illuminator model A-3000 from Dolan Jenner.

Alternatively, an off line sensing system 164 can be used. Typically, off line sensing systems measure the amount of marking material present on a receiver sample. An example of a sensing system 164 suitable to perform this type of measurement is a spectrodensitometer, model number 530, commercially available from X-rite Inc. of Grandville Mich.

Material sensing system 164 can also be used to calibrate printing system 20. Typically, system calibration is performed when the printing system 20 is starting up, when the marking material or media type is changed, before critical printing jobs are performed, or when the printing system 20 is otherwise out of calibration. During calibration, printhead 103 can be translated to a calibration station 163 including material sensing system 164. Calibration station 163 can be positioned next to cleaning station 162. Alternately, cleaning and calibration can be performed in a single cleaning/calibration station 165 as shown in FIG. 1B.

Any known print scanning and correction algorithm for performing printer system calibration can be used in conjunction with the present invention. For example, calibration station 163 can scan a printed test target and form a lookup table containing data that can be used to adjust the length of time each actuating device 104 remains open. Using this data, color densities can be varied as discussed below with reference to FIGS. 8A–8C.

Referring to FIGS. 2A–3B, the discharge device 105 of the print head 103 includes a first variable area section 118 followed by a first constant area section 120. A second variable area section 122 diverges from constant area section 120 to an end 124 of discharge device 105. The first variable area section 118 converges to the first constant area section 120. The first constant area section 118 has a diameter substantially equivalent to the exit diameter of the first variable area section 120. Alternatively, discharge device 105 can also include a second constant area section 125 positioned after the variable area section 122. Second constant area section 125 has a diameter substantially equivalent to the exit diameter of the variable area section 122. Discharge devices 105 of this type are commercially available from Moog, East Aurora, N.Y.; and Vindum Engineering Inc., San Ramon, Calif.

The actuating mechanism 104 is positioned within discharge device 105 and moveable between an open position 126 and a closed position 128 and has a sealing mechanism 130. In closed position 128, the sealing mechanism 130 in the actuating mechanism 104 contacts constant area section 120 preventing the discharge of the thermodynamically stable mixture of supercritical fluid and marking material. In open position 126, the thermodynamically stable mixture of supercritical fluid and marking material is permitted to exit discharge device 105.

The actuating mechanism 104 can also be positioned in various partially opened positions depending on the particular printing application, the amount of thermodynamically stable mixture of fluid and marking material desired, etc. Alternatively, actuating mechanism 104 can be a solenoid valve having an open and closed position. When actuating mechanism 104 is a solenoid valve, it is preferable to also include an additional position controllable actuating mechanism to control the mass flow rate of the thermodynamically stable mixture of fluid and marking material.

In a preferred embodiment of discharge device 105, the diameter of the first constant area section 120 of the discharge device 105 ranges from about 20 microns to about 2,000 microns. In a more preferred embodiment, the diameter of the first constant area section 120 of the discharge device 105 ranges from about 10 microns to about 20 microns. Additionally, first constant area section 120 has a predetermined length from about 0.1 to about 10 times the diameter of first constant area section 120 depending on the printing application. Sealing mechanism 130 can be conical in shape, disk shaped, etc.

Referring back to FIGS. 1A–1C, the marking material delivery system 22 takes a chosen solvent and/or predetermined marking materials to a compressed liquid/compressed gas and/or supercritical fluid state, makes a solution and/or dispersion of a predetermined marking material or combination of marking materials in the chosen compressed liquid/compressed gas and/or supercritical fluid, and delivers the marking materials as a collimated and/or focused beam onto a receiver 106 in a controlled manner. In a preferred printing application, the predetermined marking materials include cyan, yellow and magenta dyes or pigments.

In this context, the chosen materials taken to a compressed liquid/compressed gas and/or supercritical fluid state are gases at ambient pressure and temperature. Ambient conditions are preferably defined as temperature in the range from −100 to +100° C., and pressure in the range from $1\times10^{-8}$–1000 atm for this application.

A fluid carrier, contained in the fluid source 100, is any material that dissolves/solubilizes/disperses a marking material. The fluid source 100 delivers the fluid carrier at predetermined conditions of pressure, temperature, and flow rate as a supercritical fluid, or a compressed liquid/compressed gas. Materials that are above their critical point, as defined by a critical temperature and a critical pressure, are known as supercritical fluids. The critical temperature and critical pressure typically define a thermodynamic state in which a fluid or a material becomes supercritical and exhibits gas like and liquid like properties. Materials that are at sufficiently high temperatures and pressures below their critical point are known as compressed liquids. Materials that are at sufficiently high critical pressures and temperatures below their critical point are known as compressed gasses. Materials in their supercritical fluid and/or compressed liquid/compressed gas state that exist as gases at ambient conditions find application here because of their unique ability to solubilize and/or disperse marking materials of interest when in their compressed liquid/compressed gas or supercritical state.

Fluid carriers include, but are not limited to, carbon dioxide, nitrous oxide, ammonia, xenon, ethane, ethylene, propane, propylene, butane, isobutane, chlorotrifluoromethane, monofluoromethane, sulphur hexafluoride and mixtures thereof. In a preferred embodiment, carbon dioxide is generally preferred in many applications, due its characteristics, such as low cost, wide availability, etc.

The formulation reservoir(s) 102*a*, 102*b*, 102*c* in FIG. 1A is utilized to dissolve and/or disperse predetermined marking materials in compressed liquid/compressed gas or supercritical fluids with or without dispersants and/or surfactants, at desired formulation conditions of temperature, pressure, volume, and concentration. The combination of marking materials and compressed liquid/compressed gas/supercritical fluid is typically referred to as a mixture, formulation, etc.

The formulation reservoir(s) 102*a*, 102*b*, 102*c* in FIG. 1A can be made out of any suitable materials that can safely operate at the formulation conditions. An operating range from 0.001 atmosphere ($1.013\times10^2$ Pa) to 1000 atmospheres ($1.013\times10^8$ Pa) in pressure and from −25 degrees Centigrade to 1000 degrees Centigrade is generally preferred. Typically, the preferred materials include various grades of high pressure stainless steel. However, it is possible to use other materials if the specific deposition or etching application dictates less extreme conditions of temperature and/or pressure.

The formulation reservoir(s) 102*a*, 102*b*, 102*c* in FIG. 1 should be adequately controlled with respect to the operating conditions (pressure, temperature, and volume). The solubility/dispersibility of marking materials depends upon the conditions within the formulation reservoir(s) 102*a*, 102*b*, 102*c*. As such, small changes in the operating conditions within the formulation reservoir(s) 102*a*, 102*b*, 102*c* can have undesired effects on marking material solubility/dispensability.

Additionally, any suitable surfactant and/or dispersant material that is capable of solubilizing/dispersing the marking materials in the compressed liquid/compressed gas/supercritical fluid for a specific application can be incorporated into the mixture of marking material and compressed liquid/compressed gas/supercritical fluid. Such materials include, but are not limited to, fluorinated polymers such as perfluoropolyether, siloxane compounds, etc.

The marking materials can be controllably introduced into the formulation reservoir(s) 102*a*, 102*b*, 102*c*. The compressed liquid/compressed gas/supercritical fluid is also controllably introduced into the formulation reservoir(s) 102*a*, 102*b*, 102*c*. The contents of the formulation reservoir(s) 102*a*, 102*b*, 102*c* are suitably mixed, using a mixing device to ensure intimate contact between the predetermined imaging marking materials and compressed liquid/compressed gas/supercritical fluid. As the mixing process proceeds, marking materials are dissolved or dispersed within the compressed liquid/compressed gas/supercritical fluid. The process of dissolution/dispersion, including the amount of marking materials and the rate at which the mixing proceeds, depends upon the marking materials itself, the particle size and particle size distribution of the marking material (if the marking material is a solid), the compressed liquid/compressed gas/supercritical fluid used, the temperature, and the pressure within the formulation reservoir(s) 102*a*, 102*b*, 102*c*. When the mixing process is complete, the mixture or formulation of marking materials and compressed liquid/compressed gas/supercritical fluid is thermodynamically stable/metastable, in that the marking materials are dissolved or dispersed within the compressed liquid/compressed gas/supercritical fluid in such a fashion as to be indefinitely contained in the same state as long as the temperature and pressure within the formulation chamber are maintained constant. This state is distinguished from other physical mixtures in that there is no settling, precipitation, and/or agglomeration of marking material particles within the formulation chamber, unless the thermodynamic conditions of temperature and pressure within the reservoir are changed. As such, the marking material and compressed liquid/compressed gas/supercritical fluid mixtures or formulations of the present invention are said to be thermodynamically stable/metastable. This thermodynamically stable/metastable mixture or formulation is controllably released from the formulation reservoir(s) 102*a*, 102*b*, 102*c* through the discharge device 105 and actuating mechanism 104.

In the embodiment shown in FIGS. 1A–1C, material selection device 160 is a valve having four inputs 166 connected through rigid tubing 101 to formulation reservoirs 102*a*, 102*b*, 102*c*, and fluid source 100. Additionally, material selection device 160 has one output 168 connected to printhead 103 through flexible tubing 110. Alternatively, material selection device 160 can include four individual two-position valves with the outputs of theses valves being connected through a plenum to flexible tubing 110. Suitable valves, for example, valves having a pressure rating of 3000 psi (model EH121G7DCCM) are available from Peter Paul electronics, New Britain Conn.

During the discharge process, the marking materials are precipitated from the compressed liquid/compressed gas/supercritical fluid as the temperature and/or pressure conditions change. The precipitated marking materials are preferably directed towards a receiver 106 by the discharge device 105 through the actuating mechanism 104 as a focussed and/or collimated beam. The invention can also be practiced with a non-collimated or divergent beam provided that the diameter of first constant area section 120 and printhead 103 to receiver 106 distance are appropriately small. For example, in a discharge device 105 having a 10 um first constant area section 120 diameter, the beam can be allowed to diverge before impinging receiver 106 in order to produce a printed dot size of about 60 um (a common printed dot size for many printing applications).

Discharge device 105 diameters of these sizes can be created with modern manufacturing techniques such as focused ion beam machining, MEMS processes, etc. Alternatively, capillary tubing made of PEEK, polyimide, etc. having a desired inner diameter (ca. 10 microns) and a desired outer diameter (ca. 15 microns) can be bundled together in order to form printhead 103 (for example, a rectangular array of capillaries in a 4×100, a 4×1000, or a 4×10000 matrix). Each capillary tube is connected to an actuating mechanism 104 thereby forming discharge device 105. Printing speed for a printhead formed in this fashion can be increased for a given actuating mechanism frequency by increasing the number of capillary tubes in each row.

The particle size of the marking materials deposited on the receiver 105 is typically in the range from 1 nanometers to 1000 nanometers. The particle size distribution may be controlled to be uniform by controlling the rate of change of temperature and/or pressure in the discharge device 105, the location of the receiver 106 relative to the discharge device 105, and the ambient conditions outside of the discharge device 105.

The print head 103 is also designed to appropriately change the temperature and pressure of the formulation to permit a controlled precipitation and/or aggregation of the marking materials. As the pressure is typically stepped down in stages, the formulation fluid flow is self-energized. Subsequent changes to the formulation conditions (a change in pressure, a change in temperature, etc.) result in the precipitation and/or aggregation of the marking material, coupled with an evaporation of the supercritical fluid and/or compressed liquid/compressed gas. The resulting precipitated and/or aggregated marking material deposits on the receiver 106 in a precise and accurate fashion. Evaporation of the supercritical fluid and/or compressed liquid/compressed gas can occur in a region located outside of the discharge device 105. Alternatively, evaporation of the supercritical fluid and/or compressed liquid/compressed gas can begin within the discharge device 105 and continue in the region located outside the discharge device 105. Alternatively, evaporation can occur within the discharge device 105.

A beam (stream, etc.) of the marking material and the supercritical fluid and/or compressed liquid/compressed gas is formed as the formulation moves through the discharge device 105. When the size of the precipitated and/or aggregated marking materials is substantially equal to an exit diameter of the discharge device 105, the precipitated and/or aggregated marking materials have been collimated by the discharge device 105. When the sizes of the precipitated and/or aggregated marking materials are less than the exit diameter of the discharge device 105, the precipitated and/or aggregated marking materials have been focused by the discharge device 105.

The receiver 106 is positioned along the path such that the precipitated and/or aggregated predetermined marking materials are deposited on the receiver 106. The distance of the receiver 106 from the discharge device 105 is chosen such that the supercritical fluid and/or compressed liquid/compressed gas evaporates from the liquid and/or supercritical phase to the gas phase prior to reaching the receiver 106. Hence, there is no need for a subsequent receiver drying processes. Alternatively, the receiver 106 can be electrically or electrostatically charged, such that the location of the marking material in the receiver 106 can be controlled.

It is also desirable to control the velocity with which individual particles of the marking material are ejected from the discharge device 105. As there is a sizable pressure drop from within the printhead 103 to the operating environment, the pressure differential converts the potential energy of the printhead 103 into kinetic energy that propels the marking material particles onto the receiver 106. The velocity of these particles can be controlled by suitable discharge device 105 with an actuating mechanism 104. Discharge device 105 design and location relative to the receiver 106 also determine the pattern of marking material deposition.

The temperature of the discharge device 105 can also be controlled. Discharge device temperature control may be controlled, as required, by specific applications to ensure that the opening in the discharge device 105 maintains the desired fluid flow characteristics.

The receiver 106 can be any solid material, including an organic, an inorganic, a metallo-organic, a metallic, an alloy, a ceramic, a synthetic and/or natural polymeric, a gel, a glass, or a composite material. The receiver 106 can be porous or non-porous. Additionally, the receiver 106 can have more than one layer. The receiver 106 can be a sheet of predetermined size. Alternately, the receiver 106 can be a continuous web.

Figure 4:
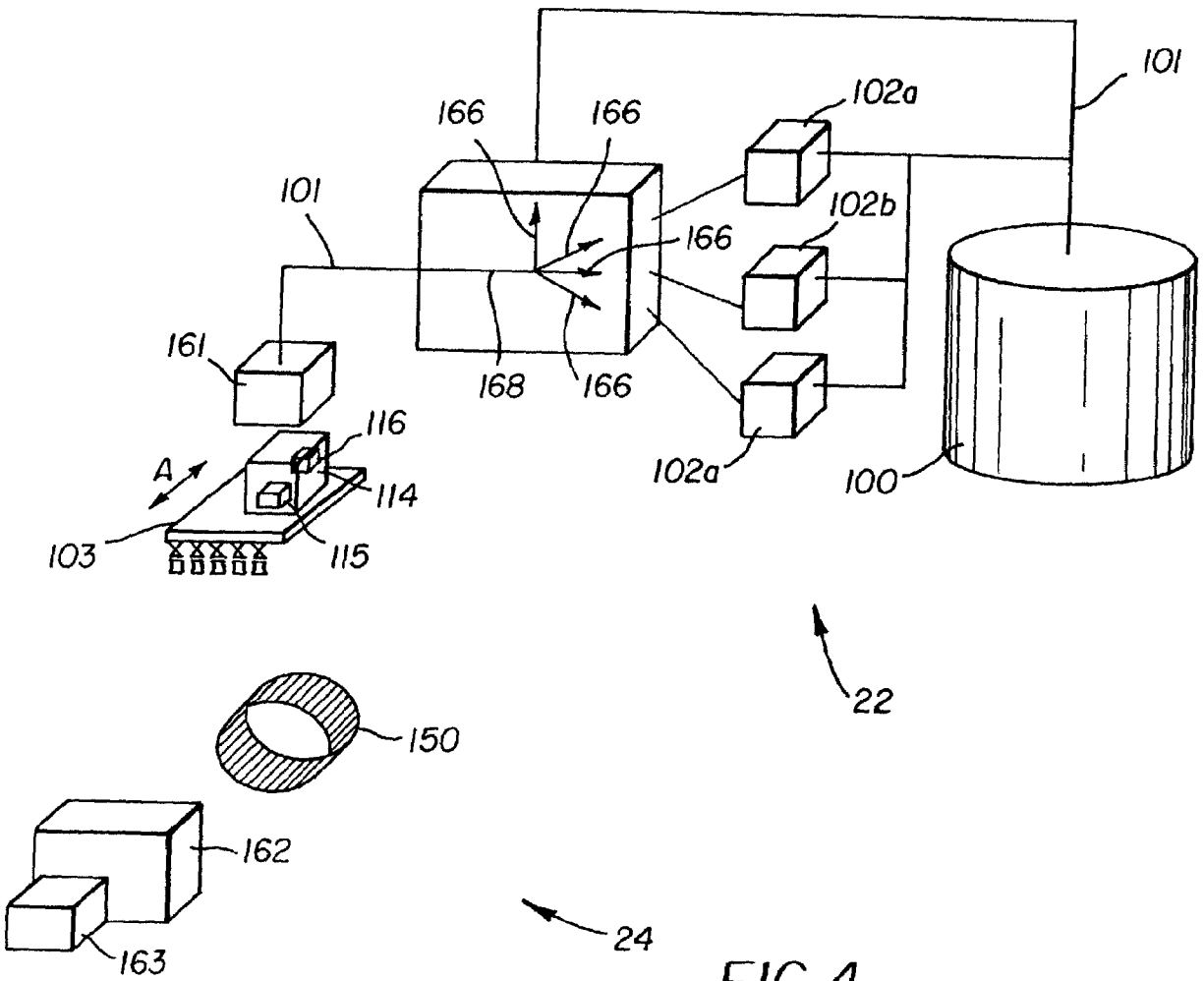
FIG. 4 is a schematic view of a second embodiment made in accordance with the present invention.

Referring to FIG. 4, an alternative embodiment is shown. An onboard reservoir 114 positioned on printhead 103 releasably mates with a docking station 161 connected to material selection device 160 through rigid tubing 101. Material selection device 160 is connected through rigid tubing 101 to fluid source 100 and formulation reservoirs 102*a*, 102*b*, 102*c*. Again, using material selection device 160 allows all discharge devices 105 to be used during each pass of the printing operation.

During operation, printhead 103 translates to docking station 161 and receives a quantity of marking material from one of formulation reservoirs 102*a*, 102*b*, 102*c* depending on the positioning of material selection device 160. The marking material is ejected onto receiver 106. Excess marking material, if any, is purged over cleaning station 162. Alternatively, printhead 103 can be calibrated, if necessary, over calibrating station 163. The process is then repeated until printing is complete.

Printhead 103 can translate back to docking station 161 (for example, to receive an additional quantity of fluid from fluid source 100) at any time during operation. This allows onboard reservoir 114 to be recharged as needed. For example, reservoir 114 can be recharged as a function of remaining pressure or weight of the formulation in reservoir 114, after a known volume of formulation has been ejected through printhead 103, after a predetermined number of translations over receiver 106, etc. Reservoir 114 is equipped with the appropriate known sensing mechanisms 116 in order to determine when reservoir 114 should be recharged.

Alternatively, reservoir 114 can be equipped with a pressure increasing device 115 that forces unused marking material and/or fluid back through docking station 161 and material selection device 160 and into the appropriate formulation reservoir 102*a*, 102*b*, 102*c*, of fluid source 100 when the marking material and/or fluid is no longer needed. An example of a suitable pressure-increasing device 115 is a variable volume piston having a regulated fluid pressure source sufficient to force the marking material and/or fluid back through the marking material delivery system 22. Alternatively a mechanical force can be applied to the piston to force the marking material and/or fluid back through marking material delivery system 22.

Figure 5:
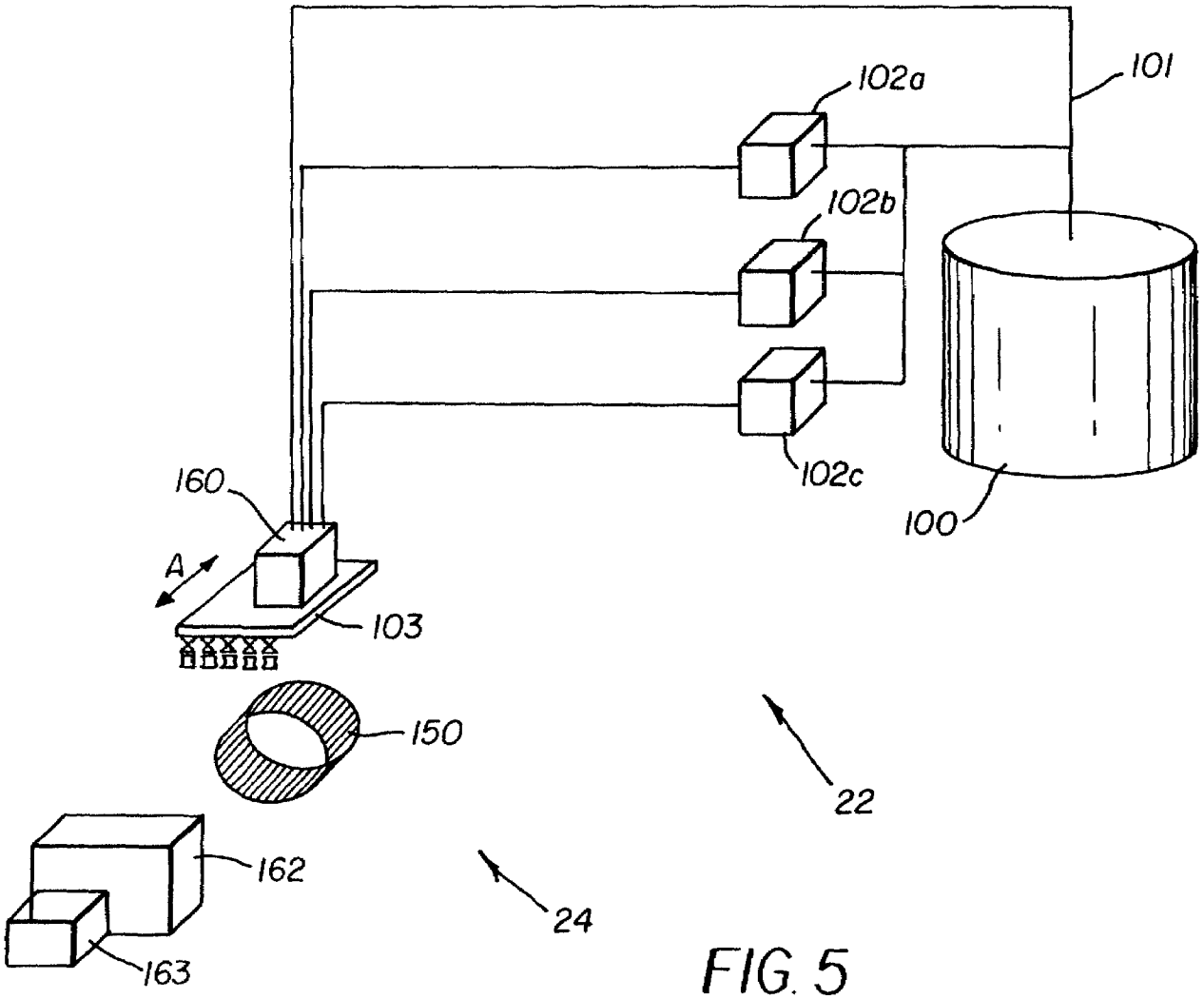
FIG. 5 is a schematic view of a third embodiment made in accordance with the present invention.

Referring to FIG. 5, another embodiment of the present invention is shown. In this embodiment, material selection device 160 is positioned on printhead 103 such that material selection device 160 and printhead 103 travel as a unit during operation. This embodiment helps to reduce waste and time associated with the cleaning process described above, for example when material selection device 160 is positioned to allow a different marking material to be ejected through printhead 103.

Figure 6:
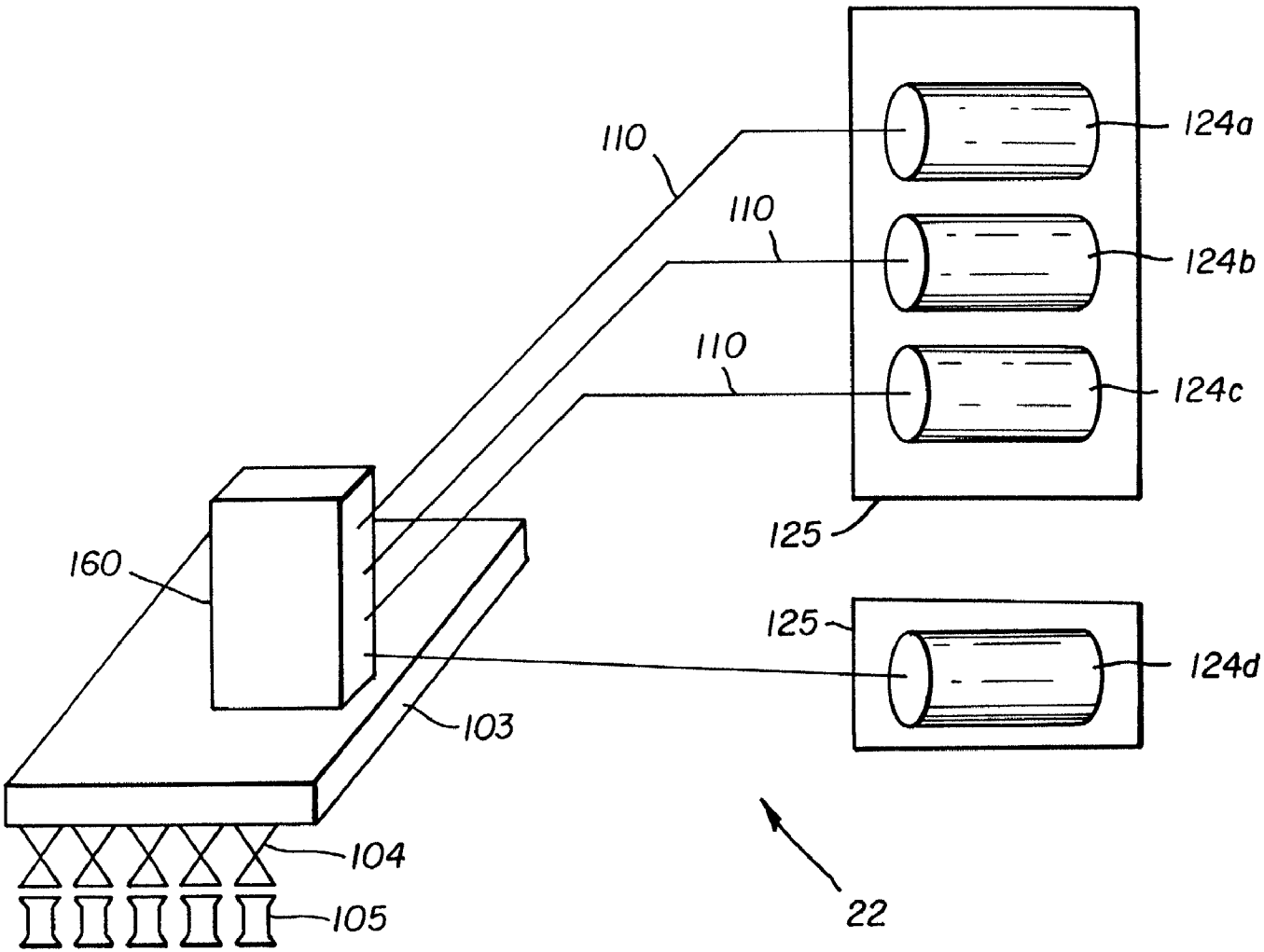
FIG. 6 is a schematic view of a fourth embodiment made in accordance with the present invention.

Referring to FIG. 6, a premixed tank(s) 124*a*, 124*b*, 124*c*, containing premixed predetermined marking materials and the supercritical fluid and/or compressed liquid/compressed gas are connected in fluid communication through tubing 110 to printhead 103. Premixed tank 124*d*, containing fluid only, is also connected in fluid communication through tubing 110 to printhead 103. The premixed tank(s) 124*a*, 124*b*, 124*c*, 124*d* can be supplied and replaced either as a set 125, or independently in applications where the contents of one tank are likely to be consumed more quickly than the contents of other tanks. The size of the premixed tank(s) 124*a*, 124*b*, 124*c*, 124*d* can be varied depending on anticipated usage of the contents. The premixed tank(s) 124*a*, 124*b*, 124*c*, 124*d* are connected to the discharge devices 105 of printhead 103 through material selection device 160 positioned on printhead 103. When multiple color printing is desired, each discharge device 105 can be utilized to eject a marking material from a particular premixed tank 124*a*, for example, and then utilized to eject a marking material from another premixed tank 124*b*, for example. Cleaning and calibrating can be accomplished as described above.

Figure 7A:
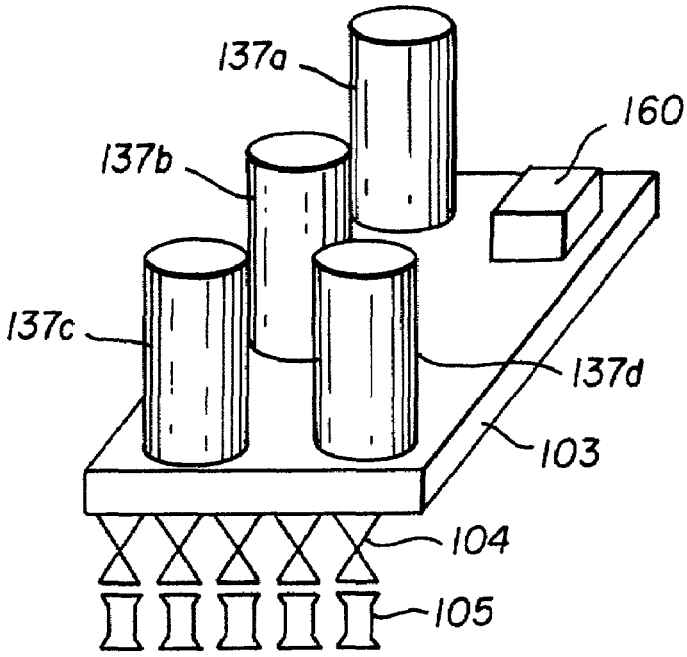
FIGS. 7A–7B is a schematic view of a fifth embodiment made in accordance with the present invention.
Figure 7B:
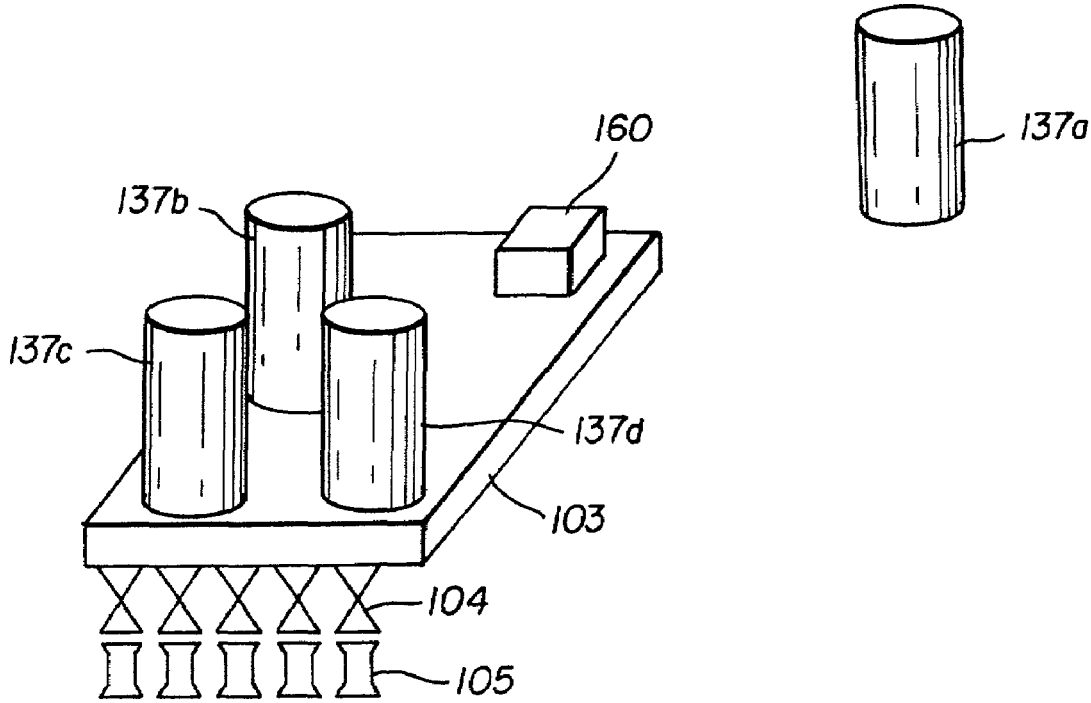

Referring to FIGS. 7A and 7B, another embodiment describing premixed canisters containing predetermined marking materials is shown. Premixed canister(s) 137*a*, 137*b*, 137*c*, 137*d* is positioned on the printhead 103. When replacement is necessary, premixed canister 137*a*, 137*b*, 137*c*, 137*d* can be removed from the printhead 103 and replaced with another premixed canister(s) 137*a*, 137*b*, 137*c*, 137*d*. Each of premixed canister(s) 137*a*, 137*b*, 137*c*, 137*d* is connected in fluid communication to discharge device 105 through material selection device 160. When multiple color printing is desired, each discharge device 105 can be utilized to eject a marking material from a particular premixed canister 137*a*, for example, and then utilized to eject a marking material from another premixed canister 137*b*, for example. Cleaning and calibrating can be accomplished as described above.

Referring back to FIGS. 1A–7B, in addition to multiple color printing, additional marking material can be dispensed through printhead 103 in order to improve color gamut, provide protective overcoats, etc. When additional marking materials are included check valves and printhead design help to reduce marking material contamination.

Each of the embodiments described above can be incorporated in a printing network for larger scale printing operations by adding additional printing apparatuses on to a networked supply of supercritical fluid and marking material. The network of printers can be controlled using any suitable controller. Additionally, accumulator tanks can be positioned at various locations within the network in order to maintain pressure levels throughout the network.

In each of the embodiments described above, there are several methods for achieving appropriate gray scale levels for each color (commonly referred to as color density) used in a given printing operation. After a nominal color value for a marking material is determined during calibration of the printing system, the color value of the marking material can be altered, as desired depending on the particular printing operation, varying one or more of the control mechanisms of the printing system.

For example, the duration that actuating mechanism 104 remains open can be varied causing the amount of marking material delivered to each printed pixel to vary. Alternatively, the duration that actuating mechanism 104 remains open can be held constant, while the flow rate of marking material through actuating mechanism 104 is varied. This can be accomplished by adjusting a marking material flow control device (for example, a valve positioned upstream from actuating mechanism 104) or by varying the open position of actuating mechanism 104. System controller can retrieve the information required to make these adjustments in any known manner, for example, retrieving the data from a look up table created during system calibration. Alternatively, the duration and flow rate can be held constant while the concentration of marking material is varied causing the amount of marking material delivered to each printed pixel to vary. Adjusting printed pixel color density using any of these methods helps to maintain maximum printer system resolution.

Figure 8A:
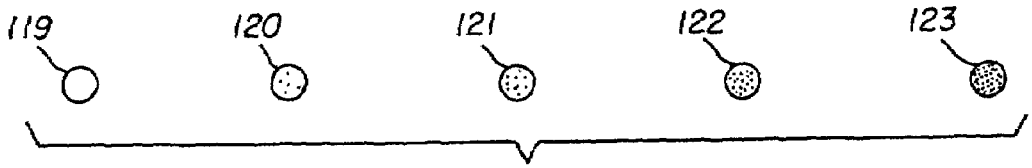
FIGS. 8A–8C are schematic views of printed pixel color density charts.
Figure 8B:
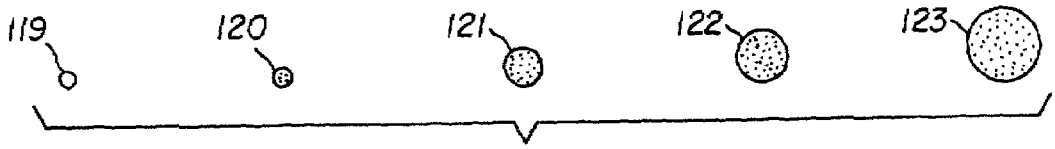
Figure 8C:
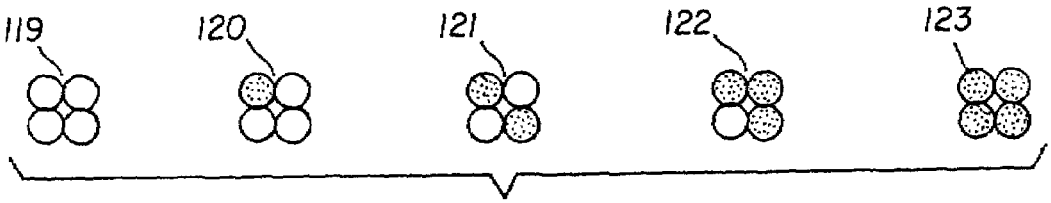

Referring to FIGS. 8A–8C, representative gray scale levels for a printed pixel 119–123 are shown. In FIGS. 8A–8C, five gray scale levels are shown for illustrative purposes only, as one of ordinary skill in the art is well aware that it is possible to create many gray scale levels for a printed pixel depending to the particular printing operation.

Referring to FIG. 8A, pixel 119 has a lowest color density which, as is the case in most printing applications, occurs when no marking material is delivered that that pixel location on a receiver. Pixel 120 has a medium low color density which can be established, for example, by determining the concentration of marking material in the fluid necessary to create pixel 120. The concentration of marking material can then be fixed with pixel 121 having medium color density, pixel 122 having a medium high color density and pixel 123 having a high color density being achieved during printing by increasing the duration that actuating mechanism 104 remains open, or increasing the flow rate of marking material through actuating 104.

Alternatively, pixel 120 can be established by determining the duration that actuating mechanism 104 remains open or the flow rate of marking material through actuating mechanism 104. When duration of actuating mechanism 104 is used to establish pixel 120, typically the most preferred duration is the minimum amount of time that actuating mechanism 104 remains open in order to establish pixel 120. This is a function of the mechanical design of actuating mechanism 104. Pixels 121–123 are then achieved by increasing the concentration of marking material in the fluid, increasing the other of the duration that actuating mechanism 104 remains open or the flow rate of marking material through actuating mechanism 104.

Referring to FIG. 8B, in some printing applications it can be advantageous to vary the size of the printed pixel 119–123 in order to achieve different color densities. This can be accomplished by varying additional control mechanisms of the printing system. For example, varying the diameter of the fluid stream exiting the discharge device can vary the size of the printed pixel 119–123. This can be accomplished, for example, by controlling the pressure differential (fluid velocity) of the printing system; providing a discharge device 105 having an actuating mechanism 104 that can open to a plurality of diameters; varying the geometry of the discharge device 105 such that multiple exit orifice sizes are provided; providing a plurality of discharge devices 105 each having a predetermined exit diameter size; etc. Alternatively, varying the distance between the discharge device 105 and the receiver 106 can vary the size of the printed pixel 119–123. This can be accomplished, for example, by positioning receiver 106 on an x, y, z translator; controlling the motion of the receiver 106 relative to the printhead 103 or the motion of the printhead 103 relative to the receiver 106; etc. Unlike conventional inkjet printing systems, printing with the present invention delivers a solvent free marking material to receiver 106. As such, problems associated with bleeding of the image (which can occur with liquid and/or solvent based inks) are reduced.

Referring to FIG. 8C, in some printing applications it can be advantageous to maintain a single actuating mechanism 104 duration and printed pixel size. In these situations, pixels 119–123 having the color densities described above can be achieved using methods known as digital half toning. In these methods, there is only one printed pixel size having one concentration of marking material, however, the multiple color densities of pixels 119–123 can be achieved by delivering a predetermined number of printed pixels to an area of the receiver that forms pixels 119–123. This is because the human eye perceives high-density dots at less than 100% coverage as a uniform lower density area on a receiver. As such, pixel 123 is created by delivering four pixels of marking material to the receiver area that makes up pixel 123. Pixel 122 is formed by delivering three pixels of marking material; pixel 121 is formed by delivering two pixels, pixel 120 is formed by delivering one pixel; and pixel 119 is formed by delivering no pixels of marking material.

The invention has been described in detail with particular reference to certain preferred embodiments thereof, but it will be understood that variations and modifications can be effected within the scope of the invention.

What is claimed is:

1. A printhead for delivering marking material to a receiver comprising:

a discharge device having an inlet and an outlet, a portion of the discharge device defining a delivery path;

an actuating mechanism moveably positioned along the delivery path; and a material selection device having an inlet and an outlet, the outlet of the material selection device being connected in fluid communication to the inlet of the discharge device, the inlet of the material selection device being adapted to be connected to a pressurized source of a thermodynamically stable mixture of a fluid and a marking material, wherein the fluid is in a gaseous state at a location beyond the outlet of the discharge device.

2. The printhead according to claim 1, wherein, the discharge device is configured to produce a shaped beam of the marking material.

3. The printhead according to claim 1, wherein the discharge device includes a variable area section.

4. The printhead according to claim 3, wherein the discharge device includes a constant area section.

5. The printhead according to claim 4, wherein the actuating mechanism has a first position in contact with the constant area section of the discharge device and a second position removed from the constant area section.

6. The printhead according to claim 1, wherein the discharge device includes a first variable area section connected to one end of a first constant area section, and a second variable area section connected to another end of the first constant area section.

7. The print head according to claim 1, wherein the discharge device includes a first variable area section connected to one end of a first constant area section, and at least one additional variable area section connected to another end of the first constant area section.

8. The print head according to claim 7, wherein the diameter of the first constant area section is from about 20 microns to 2,000 microns.

9. The print head according to claim 1, wherein the actuating mechanism includes a position controllable actuating mechanism.

10. The print head according to claim 1, wherein the actuating mechanism includes a solenoid actuating mechanism.

11. The print head according to claim 10, wherein the solenoid actuating mechanism is actuable at a plurality of frequencies.

12. A printhead for delivering marking material to a receiver comprising:

a discharge device having an inlet and an outlet, a portion of the discharge device defining a delivery path, the discharge device including a variable area section and a constant area section;

an actuating mechanism moveably positioned along the delivery path; and a material selection device having an inlet and an outlet, the outlet of the material selection device being connected in fluid communication to the inlet of the discharge device, the inlet of the material selection device being adapted to be connected to a pressurized source of a thermodynamically stable mixture of a fluid and a marking material, the fluid being in a gaseous state at a location beyond the outlet of the discharge device, wherein the actuating mechanism has a first position in contact with the constant area section of the discharge device and a second position removed from the constant area section.

13. The print head according to claim 12, the variable area section being a first variable area section, wherein the first variable area section is connected to one end of the constant area section, and at least one additional variable area section is connected to another end of the constant area section.

14. The print head according to claim 12, wherein the diameter of the constant area section is from about 20 microns to 2,000 microns.

15. The print head according to claim 12, wherein the actuating mechanism includes a position controllable actuating mechanism.

16. The print head according to claim 12, wherein the actuating mechanism includes a solenoid actuating mechanism.

17. The print head according to claim 16, wherein the solenoid actuating mechanism is actuable at a plurality of frequencies.

* * * * *